US006386691B1

(12) United States Patent
Liu

(10) Patent No.: US 6,386,691 B1
(45) Date of Patent: May 14, 2002

(54) INK CARTRIDGE OF A PRINTER FACILITATING SECOND REFILLING

(76) Inventor: Win-Yin Liu, P.O. Box 96-405, Taipei 106 (TW)

( * ) Notice: Subject to any disclaimer, the term of this patent is extended or adjusted under 35 U.S.C. 154(b) by 0 days.

(21) Appl. No.: 09/873,419

(22) Filed: Jun. 5, 2001

(51) Int. Cl.[7] ..... B41J 2/175
(52) U.S. Cl. ..... 347/85
(58) Field of Search ..... 347/85, 86, 87, 347/92; 141/59, 60, 117, 65, 25, 27

(56) References Cited

U.S. PATENT DOCUMENTS 5,633,667 A * 5/1997 Miyazawa ..... 347/86
6,164,765 A * 12/2000 Sato et al. ..... 347/85
6,172,695 B1 * 1/2001 Liu ..... 347/85
6,213,597 B1 * 4/2001 Liu ..... 347/85
6,238,042 B1 * 5/2001 Kobayashi et al. ..... 347/86

* cited by examiner

*Primary Examiner*—Michael Nghiem
(74) *Attorney, Agent, or Firm*—Troxell Law Office PLLC

(57) ABSTRACT

An ink cartridge of a printer facilitating second refiling, which has an ink cartridge and a lid, the lower end of the cartridge body having a refiling hole, which is sealed with a plug after the first refiling. The lid has a convection hole, which includes a surface to hermetically engage a refiling tube of an ink container. The bottom of the convection hole has a ventilation hole for air so as to facilitate the refilling tube of the ink container for a second refiling operation.

7 Claims, 8 Drawing Sheets

INK CARTRIDGE OF A PRINTER FACILITATING SECOND REFILLING

BACKGROUND OF THE INVENTION

1. Field of the Invention

This invention relates to an ink cartridge of a jet printer, and particularly to an ink cartridge of a printer facilitating second refilling.

2. Description of the Prior Art

In the conventional jet printer, the ink is loaded in a cartridge, and the ink jetted on the printing paper is controlled with a sprayer; when ink in the cartridge is used up, the cartridge has to be replaced for further printing operation; however, the ink cartridge supplied by the original manufacturer is considerably expensive, i.e., a user to print a lot of papers will spend a lot of money.

In the conventional ink cartridge of a jet printer, the ink chamber of the ink cartridge is usually loaded with an equalization air bladder or a piece of sponge for soaking and supplying ink. The ink cartridge supplied by the original manufacturer usually has an equal pressure in the ink chamber during the automatic manufacturing process, and there will be no leak during printing operation.

In the conventional ink cartridge loaded with a sponge, an empty ink cartridge can be replenished by sealing and closing the end opening of the output port by means of a glue paper; then, a center through hole on lid of the top surface of the ink cartridge is sealed with a membrane; a syringe is sucked with a suitable amount of ink. A slender hollow needle is used to stab through the membrane on the through hole, and to the most lower portion of the storage chamber so as to inject ink in the storage chamber; however, the sponge in the storage chamber contains a great amount of bubbles, and the ink injected is unable to exhaust the air therein; as a result, the ink injected in is limited. Since there is a mesh furnished between the storage chamber and the second chamber, if air in the second chamber is unable to exhaust, the ink in the storage chamber will be unable to enter the second chamber via the mesh, and the ink will be unable to flow into the spraying chamber.

When the ink cartridge on a printer fails to print continuously, the major cause is that the sprayer in the printing head is in short supply of ink, i.e., lack of sufficient ink flowing through the passage defined by the bearing member; in other words, if too much air enters the second chamber in the printing head, such air would enter the storage chamber of the sprayer to cause interruption of ink, i.e., having no ink to spray out; in the event of no ink to spray out of the sprayer for a considerable time, the sprayer might be burned out.

In the conventional ink cartridge, the second refilling operation is usually done in accordance with the second refilling tool made by ink-cartridge manufacturer; the refilling tube of such second-refilling ink container is often unable to connect with the refilling hole of the ink cartridge hermetically; as a result, there would be a leak upon refilling, and the ink is unable to fill into the second chamber above the ink outlet; finally, the ink cartridge refilled can not be re-used.

SUMMARY OF THE INVENTION

The prime feature of the present invention is that the lid of the ink cartridge is furnished with a convection hole; when the ink cartridge is refilled at the first time, a vacuum tube will be plugged therein so as to refill the ink cartridge by means of a vacuum convection method; after ink in the ink cartridge is used up by the printer, the convection hole can facilitate the second-refilling ink container to connect therein hermetically so as to proceed a second refilling to the ink cartridge.

Another feature of the present invention is that he lid of the ink cartridge is furnished with a convection hole, which has a cylindrical surface to be connected hermetically with the refilling tube of a second-refilling ink container; the lower part of the cylindrical surface has a stop shoulder and a ventilation hole in the center thereof. The ventilation hole is used for balancing the absorbing force of the ink sponge, and balancing the air convention upon the ink being consumed by the printer.

Still another feature of the present invention is that the convection hole in the lid of the ink cartridge is substantially a recess hole under the surface of the lid, and the top surface thereof is on the same level of the lid surface.

A further feature of the present invention is that the convection hole in the lid of the ink cartridge has a short projected part, of which the stem portion has a cylindrical surface to be connected with an ink container for second refilling.

A still further feature of the present invention is that the rectangular opening of body of the ink cartridge is mounted with a lid by means of a melting method; the upper part of the ink-storing chamber is furnished with a refilling hole, which will be closed with a seal plug after the first refilling; a spot of the lid above a chamber loaded with ink sponge is furnished with a convection hole, which includes a cylindrical surface to be connected with a refilling tube of a second-refilling ink container, and a ventilation hole for air convection on the bottom thereof so as to facilitate the connection with the refilling tube of a second-refilling ink container to proceed a second refilling.

DETAILED DESCRIPTION OF THE PREFERRED EMBODIMENT

Figure 1:
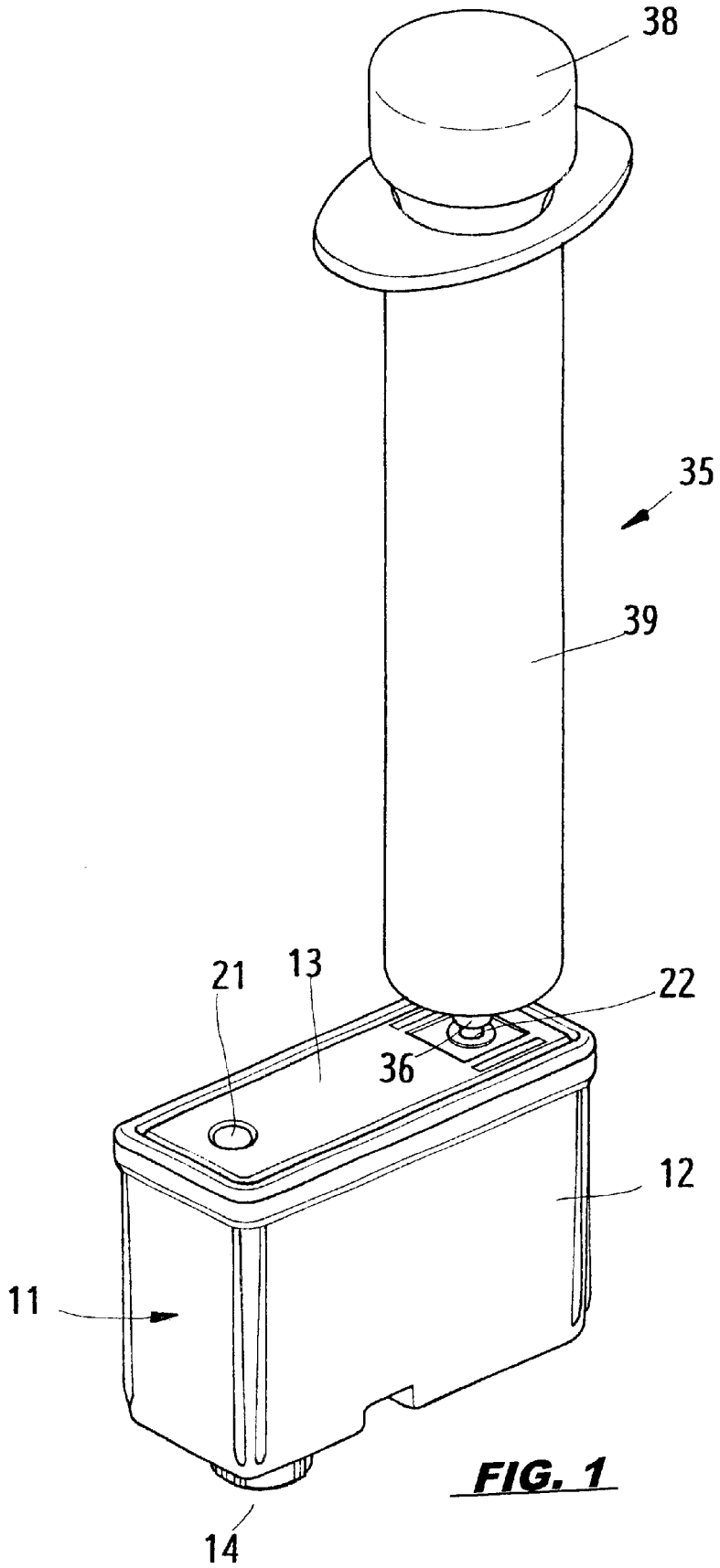
FIG. 1 is a perspective view of the present invention, showing an ink cartridge and a second refilling container connected together for refilling ink.

Referring to FIGS. 1 to 6, this invention relates to an ink cartridge 11 of a printer to facilitate second refilling; one side of bottom of the body 12 has an ink outlet 14, of which the center is mounted with a hermetic tube 17. One end of the ink outlet is closed with a seal film 18; a microfilter screen 20 is furnished between the ink outlet 14 and the storage chamber 15 so as to divide the body 12 into a storage chamber 15 with a ink sponge 16 and a second chamber 19. By means of the micro-filter screen 20, the ink consumed in the printer can be supplied in a balance condition, i.e., to have a right volume of ink flowed into the second chamber 19 at the right time.

When making an ink cartridge 11, the micro-filter screen 20 should be mounted on the bottom of the storage chamber 15 first; the ink outlet 14 of the body 12 is mounted with a hermetic tube 17, and then the ink outlet is sealed with a seal film 18. The upper end of the storage chamber 15 of the body 12 is a rectangular opening so as to facilitate an ink sponge 16 to put therein for absorbing and storing ink in the ink cartridge 11; then, the opening of the body 12 is closed with a lid 13 by melting method. The top of the lid 13 has a refilling hole 21 and a convection hole 22, which are to be connected hermetically with a refilling tube 30 and a vacuum tube 31 respectively during first time ink-filling so as to provide a vacuum and convection filling. After the first time ink-filling, the cylindrical surface 23 of the refilling hole 21 is sealed with a seal plug 26; then, the convection hole 22 and the refiling hole 21 are closed with label film 27A, 27B through melting method. The ink cartridge 11 can be stored up and shipped without leaking.

The lid 13 sealed to the body 12 is made in the same shape corresponding to the opening of the body 12; the lid 13 is mounted to the opening of the body 12, and then is sealed in place through melting method. The outer surface of the lid 13 is furnished with a refilling hole 21; the refilling hole 21 is substantially a recess hole, of which the cylindrical surface 23 is a tapered one so as to fit and connect with the hermetic cylinder 33 of the refilling tube 30, i. e., when the refilling tube 30 is plugged into the hole, a hermetic connection can be obtained. The bottom of the cylindrical surface 23 in the refilling hole 21 has a stop shoulder 25, of which the center has a through hole 24 for receiving an elongate tube 32 of the refilling tube 30 to extend into the ink sponge 16. The convection hole 22 located on one end of the lid 13 is to be plugged hermetically with a vacuum tube 31 so as to provide a convection refilling method to have ink refilled into the ink sponge 16 in the storage chamber 15 of the ink cartridge 11.

The convection hole 22 of the lid 13 is also a recess hole, of which the cylindrical surface 28 is a tapered one so as to fit the second refilling ink container 35 and the vacuum tube 31 hermetically upon connecting together. The bottom of the cylindrical surface 28 in the convection hole 22 has a stop shoulder 37, of which the center has a ventilation hole 29; since the ventilation hole 29 has a sufficient size, it can provide sufficient vacuum sucking force upon the ink cartridge 11 being refilled first by means of vacuum convection method.

Figure 3:
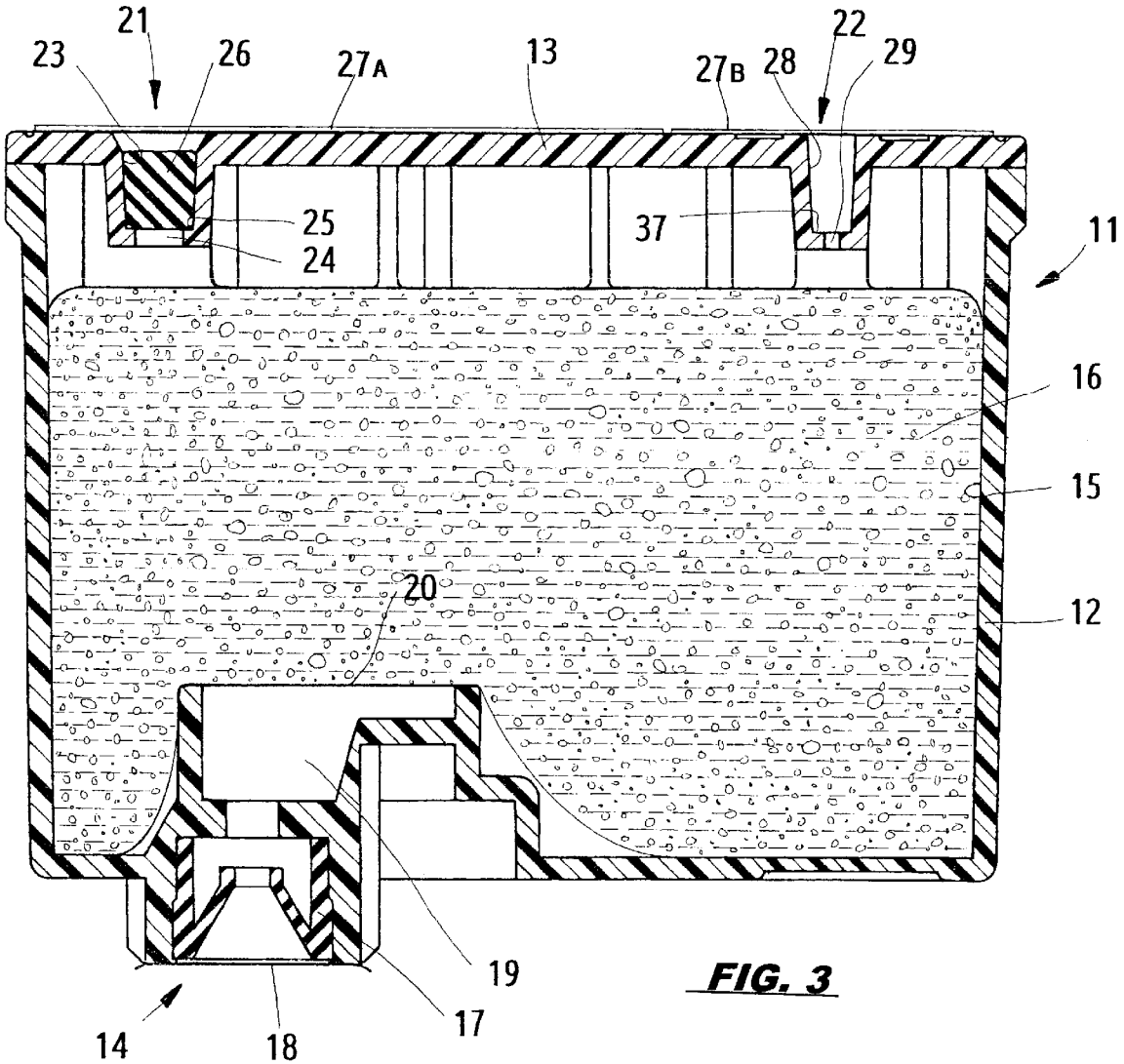
FIG. 3 is a sectional view of the present invention, showing the structure of the ink cartridge.
Figure 4:
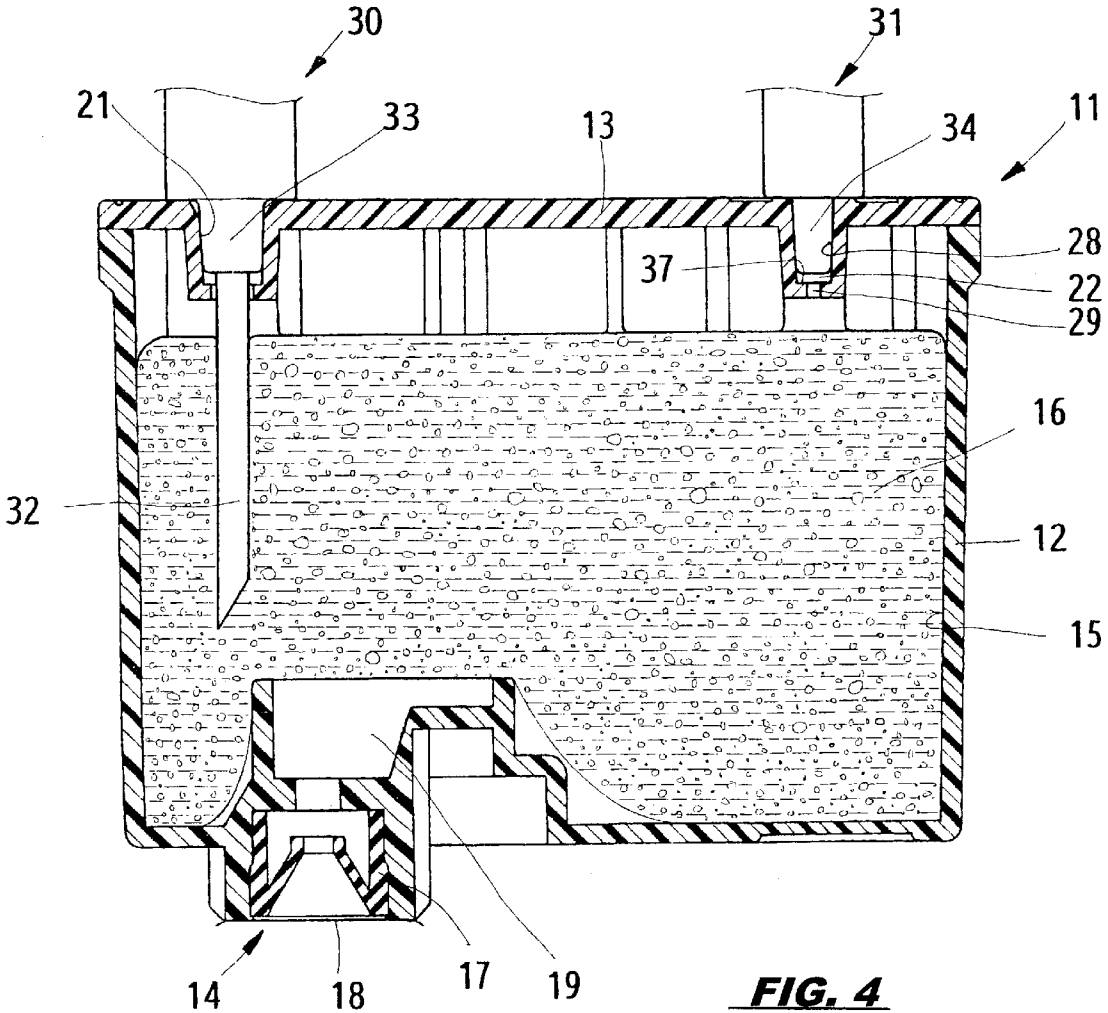
FIG. 4 is a sectional view of the present invention, showing the ink cartridge being refilled first

As shown in FIG. 4, when the ink cartridge 11 is refilled with the vacuum convection method, the refilling hole 21 and the convection hole 22 in the lid 13 will be plugged with a refilling tube 30 and a vacuum tube 31 hermetically and respectively; the elongate tube 32 of the refilling tube 30 will extend into the ink sponge 16 of the storage chamber 15 in the body 12, and the hermetic cylinder 33 will be connected hermetically with the cylindrical surface 23 of the refilling hole 21; the hermetic cylinder 34 of the vacuum tube 31 will be connected hermetically with the cylindrical surface 28 of the convection hole 22. The other ends of the refilling tube 30 and the vacuum tube 31 are connected respectively with an ink bucket and a vacuum device; through the control of a switch valve, a given quantity of ink will be refilled into the storage chamber 15 of the ink cartridge 11 smoothly by means of the vacuum convection method, and then the ink will be stored in the ink sponge 16. As shown in FIG. 3, the refilling tube 30 and the vacuum tube 31 are removed, and the refilling hole 21 of the lid 13 is sealed with a seal plug 26; then, label film 27A, 27B is attached to the top of the lid 13 through a melting method; the label film 27A, 27B can provide a label indication and a seal function to the vacuum hole 22 to prevent from leaking during shipping.

Before the ink cartridge 11 is mounted on a printer as shown in FIG. 3, tear off the label film 27B on the convection hole 22 of the lid 13 first without touching the label film 27A on the refilling hole 21. After tearing off the label film 27B on the convection hole 22, the ventilation hole 29 in the bottom of the convection hole 22 will be opened; the ink cartridge 11 is mounted on a printer, being ready for printing. During printing, the ink in the ink sponge 16 of the storage chamber 15 will flow through the micro-filter screen 20 and the ink outlet 14 to the printing head as a result of air convection by means of the ventilation hole 29.

Figure 2:
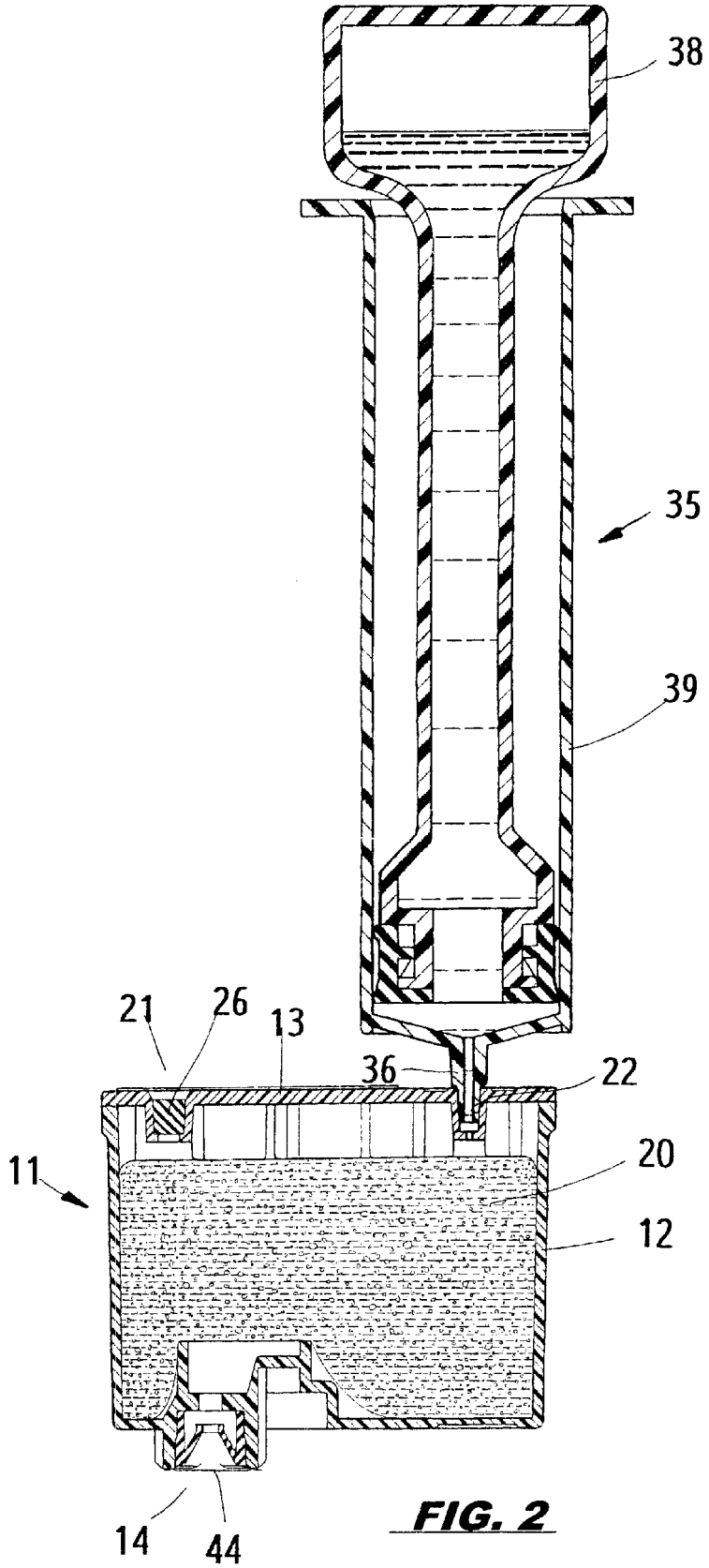
FIG. 2 is a sectional view of the present invention, showing the connection structure between the ink cartridge and the second-refilling container.
Figure 5:
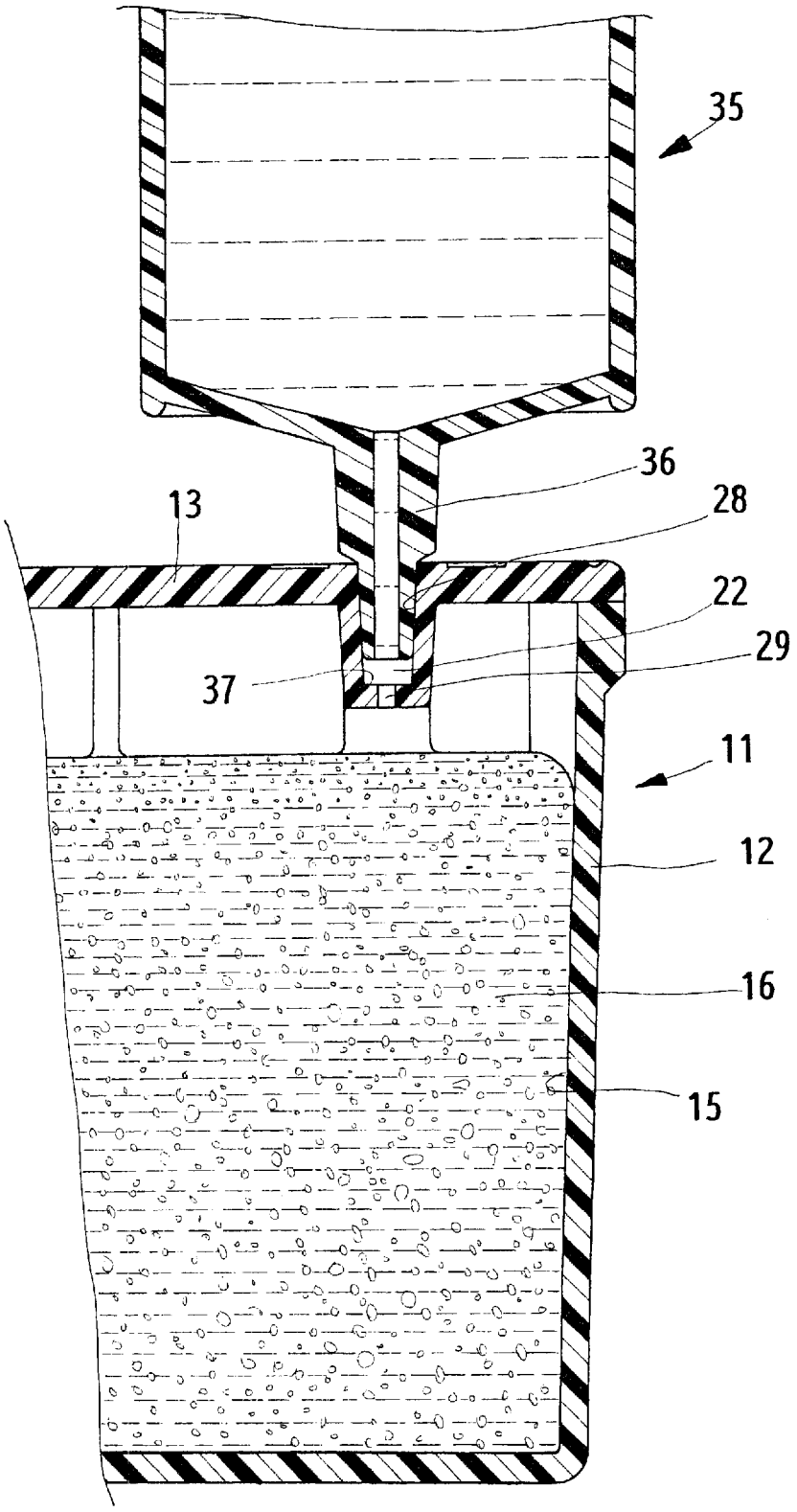
FIG. 5 is an enlarged sectional view of the present invention, showing the convection hole of the lid of the ink cartridge connected together with the second-refilling container.

As shown in FIGS. 1, 2 and 5, the seal film 18 of the ink outlet 14 of the ink cartridge 11 will be stabbed through upon being mounted to a printer; after the ink cartridge 11 is removed from a printer for second refilling, the ink outlet 14 should be sealed with a new glue paper 44 so as to have the ink outlet 14 sealed hermetically as usual. When the ink cartridge 11 is refilled at second time, the refilling tube 36 of the ink container 35 must have the same shape to fit the convection hole 22 of the lid 13; the refilling tube 36 can be plugged into the convection hole 22 of the lid 13 smoothly. The container cylinder 38 of the ink container 35 for second refilling extends out; the user holds the outer cylinder 39 with one hand, while the other hand pulls the container cylinder 38 upwards; then, a negative pressure in a sealed space between the inside of the ink container 35 and the storage chamber 15 of the ink cartridge 11 will be produced so as to direct the air in the storage chamber 15 into the upper portion of the ink in the container cylinder 38; discontinue to pull the container cylinder 38 for several seconds, and then release the pulling hand from the container cylinder; then, the container cylinder 38 will return to the original position as a result of the negative pressure in the ink cartridge 11. The ink in the lower part of the container cylinder 38 will flow into the ink sponge 16 of the storage chamber 15 upon the container cylinder 38 moving backwards; after the aforesaid steps are repeated several time, the vacuum refilling operation for the ink cartridge 11 will be done, and the printer can operate continuously because of the ink cartridge supplying ink continuously.

Figure 6:
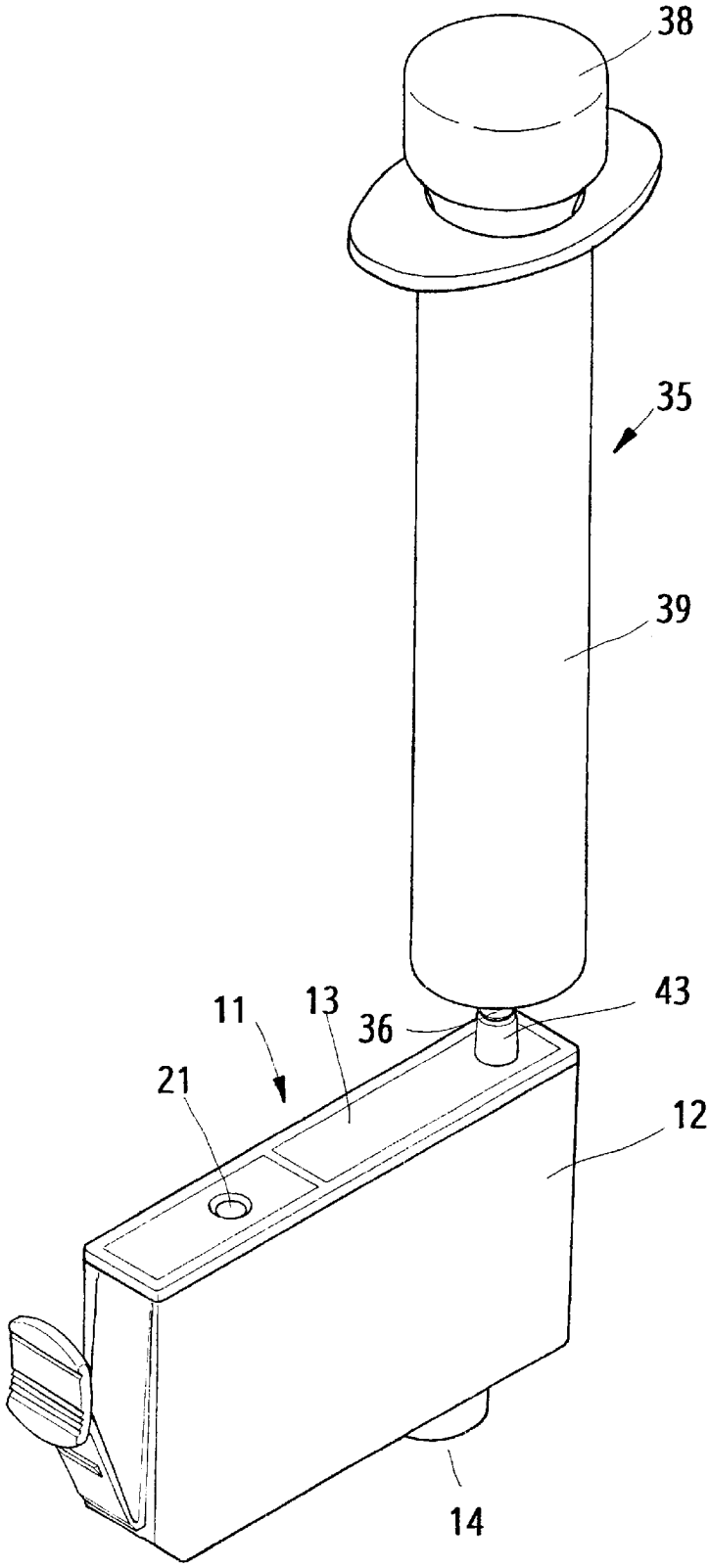
FIG. 6 is a sectional view of the present invention, showing a second ink cartridge connected together with the second-refilling container for refilling operation.
Figure 7:
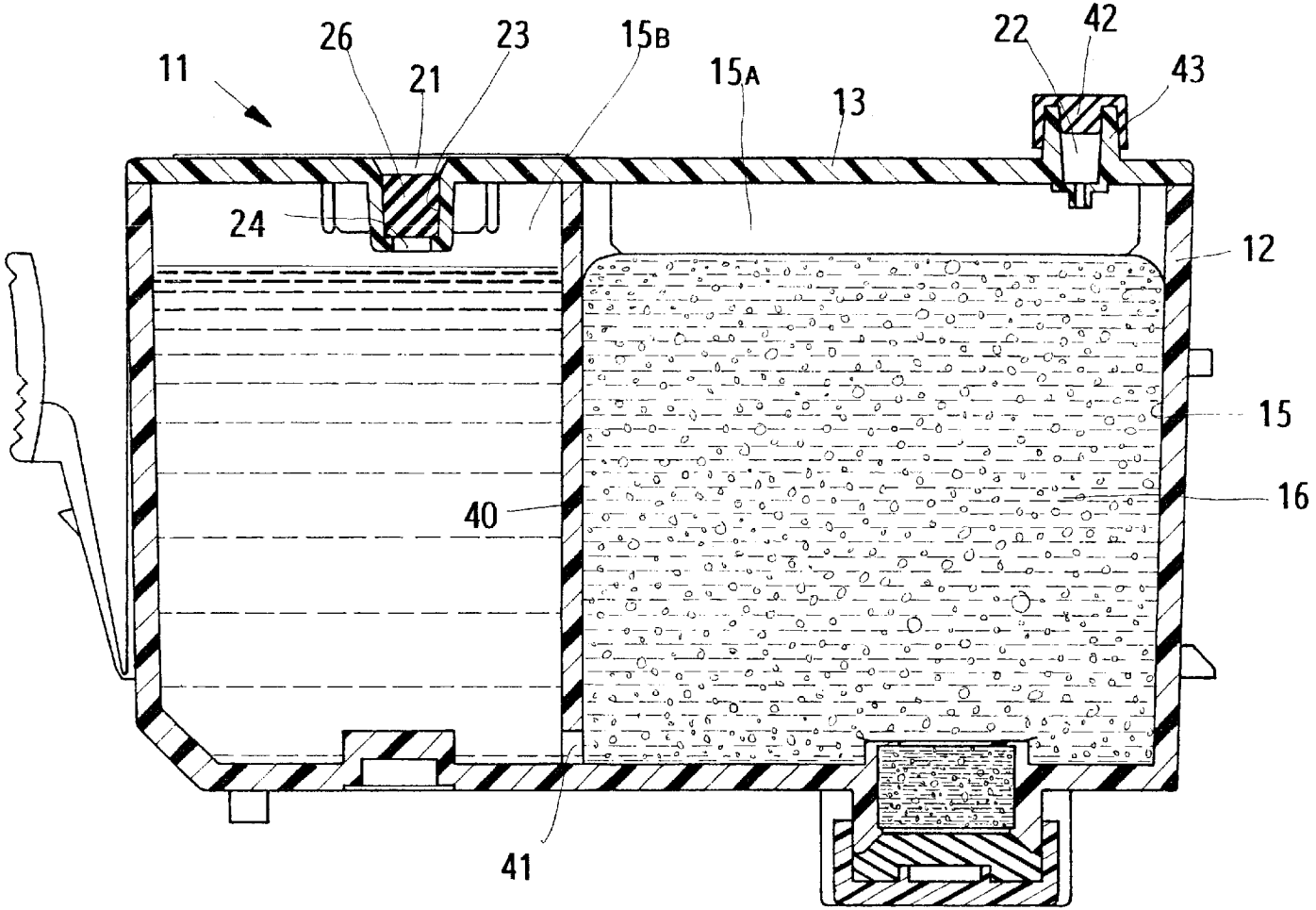
FIG. 7 is a sectional view of the present invention, showing the structure of a second ink cartridge.
Figure 8:
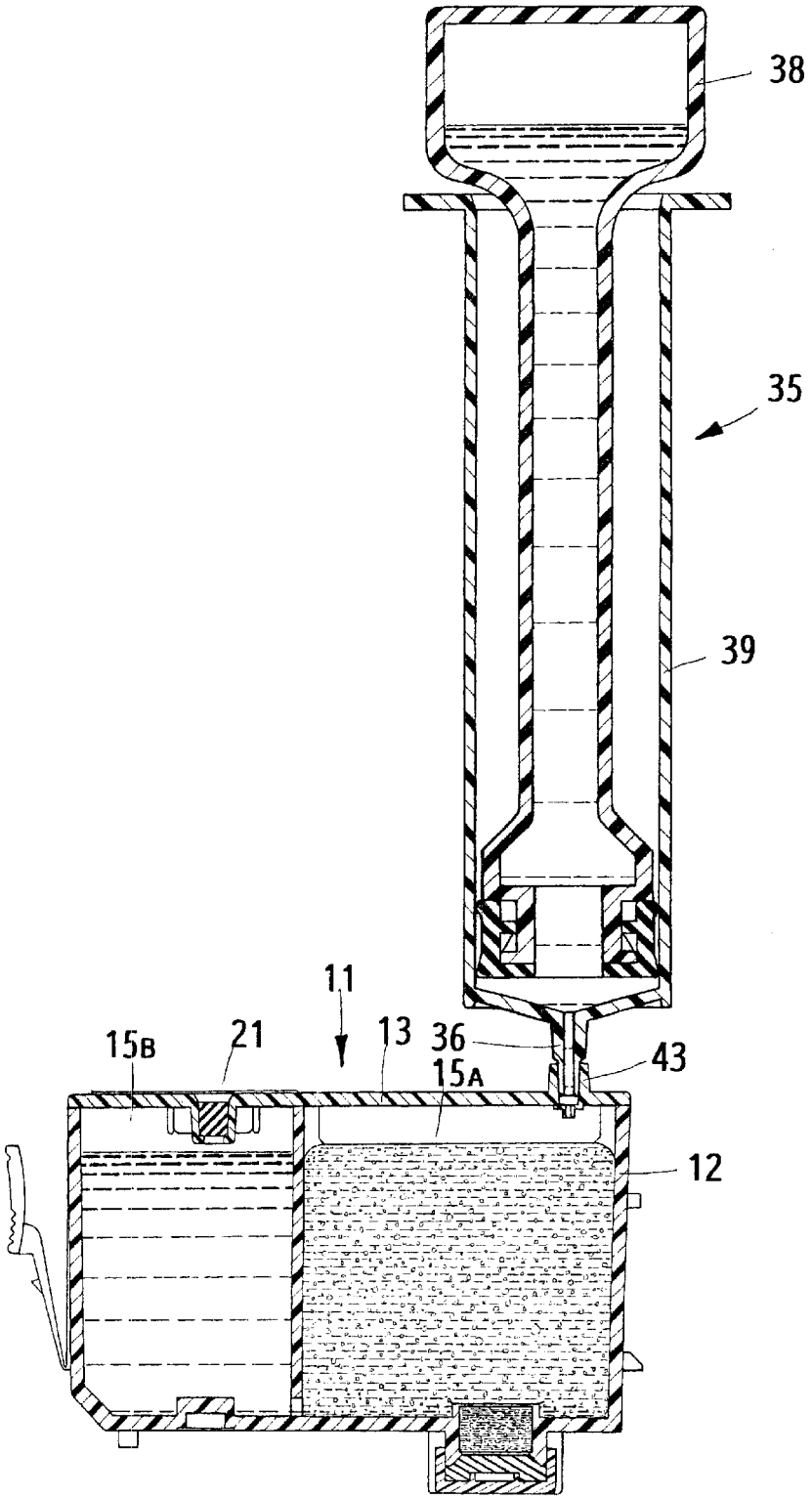
FIG. 8 is a sectional view of the present invention, showing the connection structure between the ink cartridge and the second-refilling container.

As shown in FIGS. 6 and 7, the storage chamber 15 of the ink cartridge 11 is divided into two chambers 15A and 15B; the chamber 15A is loaded with ink sponge 16 for absorbing ink, while the chamber 15B is a hollow chamber for storing ink. The two chambers 15A and 15B are separated with an isolation plate 40, of which the lower end has a through hole 41 for continuously supplying ink consumed in chamber 15A. For the first ink-refilling to ink cartridge 11, the ink outlet 14 is clamped with a clamp so as to provide a hermetic connection. The refilling hole 21 and the convection hole 22 of the lid 13 are plugged hermetically with the refilling tube 30 and the vacuum tube 31 respectively for the first refilling of the ink cartridge 11. After the refilling is completed, the refilling hole 21 and the convection hole 22 should be closed with a seal plug 26 and a hermetic cap 42 respectively so as to prevent the ink cartridge 11 from leaking during shipping.

Before the ink cartridge 11 is mounted to a printer, the clamp mounted to the ink outlet 14 and the hermetic a cap 42 on the convection hole 22 must be removed. When ink in the ink sponge 16 of the storage chamber 15 in the ink cartridge 11 is used up, the ink cartridge should be removed from the printer, and the ink outlet 14 should be mounted in the clamp; then, the second refilling may be processed through the convection hole 22 of the lid 13. The top of the convection hole 22 in the lid 13 has a short portion projected out of the surface of the lid 13; a stem portion 43 on the convection hole is furnished with a cylindrical surface 28 to be connected hermetically with a refilling tube 36 of the second-refilling ink container 35. The second refilling operation for the ink cartridge 11 can be done by using the method mentioned in the first embodiment In the present invention, the lid 13 of the ink cartridge 11 is furnished with a refilling hole 21 and a convection hole 22; the refilling hole 21 will be sealed after the first refilling so as to keep the pressure in the storage chamber 15 of the ink cartridge 11 in a balance condition during printing. For the second refilling to the ink cartridge 11, the refilling tube 36 of the ink container 35 should be connected hermetically in place for the second convection refilling to the ink cartridge 11. The aforesaid embodiments have been described respectively to disclose the structure of the lid and the feature of refilling hole and the convection hole; it is apparent that the present invention has provided an obvious improvement and novelty for achieving an object as expected, and such object has never been anticipated and achieved by any person in the field.

What is claimed is:

1. An ink filling system comprising:

an ink cartridge for a printer capable of being refilled by an ink container having a refilling tube, the ink cartridge comprising:

a) a body having a hollow interior, an ink outlet on a lower portion communicating with the hollow interior, and an open upper portion;

b) a lid mounted on the body so as to cover the open upper portion;

c) an ink sponge located in the hollow interior, the ink sponge having an upper surface spaced from the lid;

d) a refilling hole formed in the lid; and, e) a convection hole formed in the lid and configured to hermetically receive the refilling tube of the ink container therein, a bottom of the convection hole bounded by a stop shoulder forming a ventilation hole, the stop shoulder preventing the refilling tube from contact with the ink sponge.

2. The ink filing system of claim 1 wherein the convection hole comprises a recessed hole with an upper portion at a same level as an upper surface of the lid.

3. The ink filing system of claim 1 wherein the lid has an upper surface and further comprising a stem portion extending above the upper surface of the lid wherein the convection hole is formed in the stem portion.

4. The ink filing system of claim 1 further comprising an isolation plate dividing the hollow interior of the body into an ink storing chamber and an ink sponge chamber in which the ink sponge is located, wherein the refilling hole communicates with the ink storing chamber and the convection hole communicates with the ink sponge chamber.

5. The ink filing system of claim 4 wherein the lid has an upper surface and further comprising a stem portion extending above the upper surface of the lid wherein the convection hole is formed in the stem portion.

6. The ink filing system of claim 1 further comprising a label film attached to an upper surface of the lid and covering at least the refilling hole.

7. The ink filing system of claim 1 further comprising a label film attached to an upper surface of the lid and covering at least the convection hole.

* * * * *